US007142677B2

(12) United States Patent
Gonopolskiy et al.

(10) Patent No.: US 7,142,677 B2
(45) Date of Patent: Nov. 28, 2006

(54) DIRECTIONAL SOUND ACQUISITION

(75) Inventors: Aleksandr L. Gonopolskiy, Southfield, MI (US); Gamze Erten, Okeomos, MI (US)

(73) Assignee: Clarity Technologies, Inc., Troy, MI (US)

( * ) Notice: Subject to any disclaimer, the term of this patent is extended or adjusted under 35 U.S.C. 154(b) by 863 days.

(21) Appl. No.: 09/907,046

(22) Filed: Jul. 17, 2001

(65) Prior Publication Data

US 2003/0072460 A1 Apr. 17, 2003

(51) Int. Cl.
*H04R 3/00* (2006.01)

(52) U.S. Cl. ..... 381/92; 381/94.1

(58) Field of Classification Search ..... 381/92, 381/71.1–71.14, 83, 93, 94.1–94.9
See application file for complete search history.

(56) References Cited

U.S. PATENT DOCUMENTS

| | | | | |
|---|---|---|---|---|
| 4,489,442 | A | 12/1984 | Anderson et al. | |
| 4,862,507 | A | 8/1989 | Woodard | |
| 4,888,807 | A | 12/1989 | Reichel | |
| 5,208,786 | A | 5/1993 | Weinstein et al. | |
| 5,208,864 | A * | 5/1993 | Kaneda | 704/258 |
| 5,315,532 | A | 5/1994 | Comon | |
| 5,383,164 | A | 1/1995 | Sejnowski et al. | |
| 5,506,908 | A | 4/1996 | Baumhauer, Jr. | |
| 5,539,832 | A | 7/1996 | Weinstein et al. | |
| 5,625,697 | A | 4/1997 | Bowen et al. | |
| 5,633,935 | A | 5/1997 | Kanamori et al. | |
| 5,848,172 | A | 12/1998 | Allen et al. | |
| 5,901,232 | A | 5/1999 | Gibbs | |
| 5,946,403 | A | 8/1999 | Josephson et al. | |
| 6,041,127 | A * | 3/2000 | Elko | 381/92 |
| 6,122,389 | A | 9/2000 | Grosz | |
| 2002/0009203 | A1 * | 1/2002 | Erlen | 381/92 |

FOREIGN PATENT DOCUMENTS

| | | |
|---|---|---|
| EP | 1 065 909 A2 | 6/1999 |
| WO | WO 01/95666 A2 | 6/2000 |

OTHER PUBLICATIONS

V. Davidek et al., Implementing a Noise Cancellation System w ith the TMS320C31, ESIEE, Paris, Sep. 1996, pp. 1-23.

* cited by examiner

*Primary Examiner*—Vivian Chin
*Assistant Examiner*—Corey Chau
(74) *Attorney, Agent, or Firm*—Brooks Kushman P.C.

(57) ABSTRACT

Directional sound acquisition is obtained by combining directional sensitivities in microphones with signal processing electronics to reduce the effects of noise received from unwanted directions. One or more microphones having directional sensitivity including a minor lobe pointing in the particular direction of interest and a major lobe pointing in a direction other than the particular direction are used. Signal processing circuitry reduces the effect of sound received from directions of a microphone major lobe.

26 Claims, 15 Drawing Sheets

DIRECTIONAL SOUND ACQUISITION

BACKGROUND OF THE INVENTION

1. Field of the Invention

The present invention relates to sensing sound from a particular direction.

2. Background Art

Directional microphone systems are designed to sense sound from a particular set of directions or beam angle while rejecting, filtering out, blocking, or otherwise attenuating sound from other directions. To achieve a high degree of directionality, microphones have been traditionally constructed with one or more sensing elements or transducers held within a mechanical enclosure. The enclosure typically includes one or more acoustic ports for receiving sound and additional material for guiding sound from within the beam angle to sensing elements and blocking sound from other directions.

Directional microphones may be beneficially applied to a variety of applications such as conference rooms, home automation, automotive voice commands, personal computers, telecommunications, personal digital assistants, and the like. These applications typically have one or more desired sources of sound accompanied by one or more noise sources. In some applications with a plurality of desired sources, a desired source may represent a source of noise with regards to another desired source. Also, in many applications microphone characteristics such as size, weight, cost, ability to track a moving source, and the like have a great impact on the success of the application.

Several problems are associated with directional microphones of traditional design. First, to achieve desired directionality, the enclosure is elongated along an axis in the direction of the desired sound. This tends to make directional microphones bulky. Also, microphone transducing elements are often expensive in order to achieve the necessary signal-to-noise ratio and sensitivity required for detecting sounds located some distance from the microphone. Special acoustic materials to direct the desired sound and block unwanted sound add to the microphone cost. Further, highly directional microphones are difficult to aim, requiring large and expensive automated steering systems.

What is needed is directional sound acquisition that permits the microphone to be reduced in both cost and size. Preferably, such directional sound acquisition should be accomplished with existing microphone elements, standard signal processing devices, and the like. Further, a directional sound acquisition system microphone should be steerable towards a sound source.

SUMMARY OF THE INVENTION

The present invention provides for directional sound acquisition by combining heretofore unexploited directional sensitivities in microphones and signal processing electronics to reduce the effects of sound received from other directions.

A system for acquiring sound in a particular direction is provided. The system includes at least one microphone. Each microphone has a directional sensitivity comprising a minor lobe pointing in the particular direction and a major lobe pointing in a direction other than the particular direction. Signal processing circuitry reduces the effect of sound received from directions of the microphone major lobe.

In an embodiment of the present invention, at least one microphone has a hypercardioid polar response pattern.

In another embodiment of the present invention, at least one microphone is a gradient microphone. This gradient microphone may have a non-cardioid polar response pattern.

In still another embodiment of the present invention, a pair of microphones are collinearly aligned in the particular direction.

In various other embodiments of the present invention, signal processing circuitry may reduce the effects of sound received from directions of the major lobe through spectral filtering, gradient noise cancellation, spatial noise cancellation, signal separation, threshold detection, one or more combinations of these, and the like.

A method for acquiring sound in a particular direction is also provided. A microphone is aimed in the particular direction. The microphone has a directional sensitivity including a first lobe pointed in the particular direction and a second lobe pointed in a direction other than the particular direction. The first lobe has less sound sensitivity than the second lobe. The microphone generates an electrical signal based on sound sensed from the particular direction as well as from other directions. The electrical signal is processed to extract effects of sound sensed in directions other than the particular direction.

A method of improving the directionality of a hypercardioid microphone having a directional sensitivity including a minor lobe and a major lobe is also provided. The microphone minor lobe is pointed in a desired direction. Sound received in sensitive directions defined by the minor lobe and the major lobe is converted into an electrical signal. The electrical signal is processed to reduce the effects of sound received in sensitive directions defined by the major lobe.

A system for acquiring sound information from a desired source in the presence of sound from other sources is also provided. The system includes at least one pair of microphones. Each microphone has a directional sensitivity including a minor lobe pointed towards the desired source and a major lobe not pointed towards the desired source. The minor lobe has a narrower beam width than the major lobe. A processor in communication with each pair of microphones extracts source sound information from amongst sound from other sources.

In an embodiment of the present invention, the processor computes the parameters of a signal separation architecture.

In another embodiment of the present invention, the system acquires sound information from a plurality of desired sources. The system includes at least one pair of microphones for each desired source. At least two pairs of microphones may share a common microphone.

A system for acquiring sound is also provided. The system includes a base. A housing is rotatively mounted to the base. The housing has at least one magnet facing the base. At least one microphone is disposed within the housing. Magnetic coils, disposed within the base, are energized such that at least one coil magnetically interacts with a magnet to rotatively position the microphone relative to the base.

In an embodiment of the present invention, control logic turns a sequence of the magnetic coils on and off to change the position of the microphone relative to the base.

A system for acquiring sound information from a desired source in the presence of sound from other sources is also provided. The system includes a base. A housing is rotatively mounted to the base at a pivot point. The housing has at least one magnet facing the base. At least one pair of microphones is disposed within the housing. Each microphone has a directional sensitivity comprising a minor lobe pointed away from the pivot point and a major lobe pointed towards the pivot point, the minor lobe having a narrower beam width than the major lobe. A plurality of magnetic coils is disposed within the base such that energizing at least one coil creates magnetic interaction with at least one of the magnets to rotatively position the housing so as to point each microphone minor lobe towards the desired source. A processor extracts source sound information from amongst sound from other sources.

In an embodiment of the present invention, the plurality of magnetic coils are arranged in at least one ring concentric with the pivot point.

A method of improving the directionality of a hypercardioid microphone is also provided. The microphone has a directional sensitivity comprising a minor lobe and a major lobe. The microphone is mounted in a housing rotatively coupled to a base. At least one magnetic coil is energized in the base to point the microphone minor lobe in a desired direction, each energized magnetic coil magnetically interacting with a magnet in the housing. Sound received in sensitive directions defined by the minor lobe and the major lobe is converted into an electrical signal. The electrical signal is processed to reduce the effects of sound received in sensitive directions defined by the major lobe.

A method for acquiring sound in a particular direction is also provided. A microphone is mounted in a housing rotatively coupled to a base. The microphone is aimed in the particular direction by magnetic interaction between at least one of a plurality of coils in the base and at least one magnet in the housing. The microphone generates an electrical signal based on sound sensed from the particular direction and from the direction other than the particular direction. The electrical signal is processed to extract effects of sound sensed in the direction other than the particular direction.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

Figure 1:
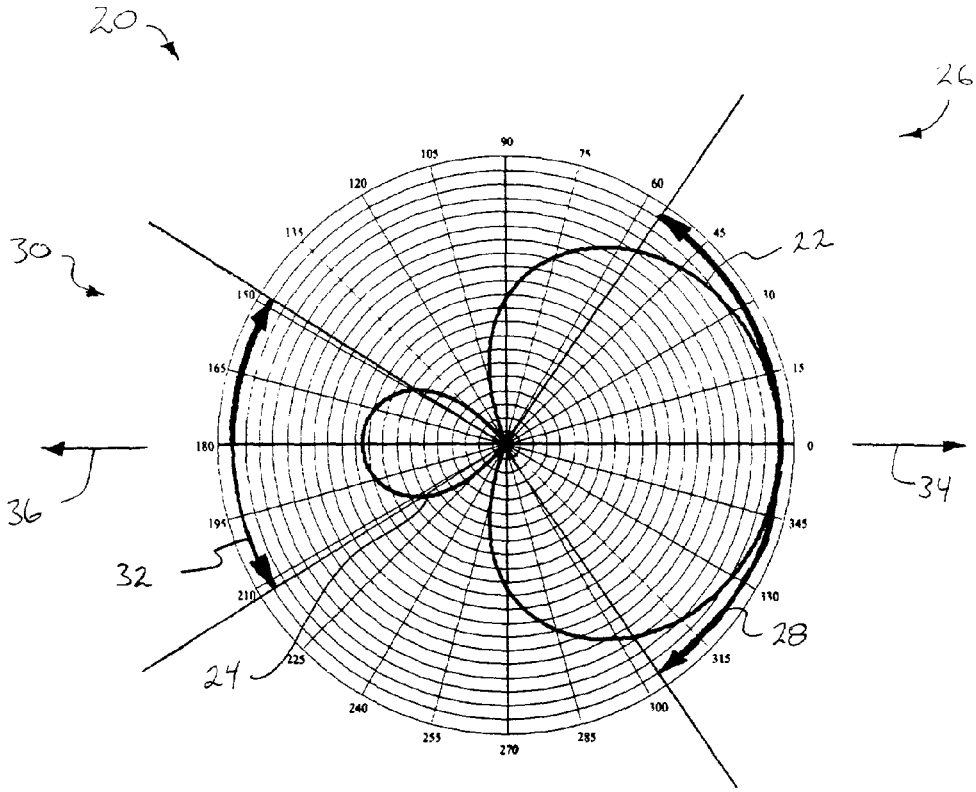
FIG. 1 is a polar response plot of a microphone hypercardioid response pattern.

Referring to FIG. 1, a polar response plot of a microphone hypercardioid response pattern is shown. A hypercardioid polar response pattern, shown generally by 20, illustrates directional sensitivity to sound generated at various angular locations around a plane of the microphone. At a particular angular location about the microphone, a plot value farther from the center of polar plot 20 indicates a greater sensitivity. An ideal first-order hypercardioid plot, as depicted in FIG. 1, contains two lobes, major lobe 22 and minor lobe 24. Major lobe 22 has a greater peak sound sensitivity than minor lobe 24. Major lobe 22 is also less directional than minor lobe 24. This directionality may be numerically expressed as a beam angle. Major lobe beam angle 26 is defined by an arc in which major lobe 22 has a sensitivity within a certain fraction of the peak sensitivity. For example, half power angle 28 represents the angular region in which the sensitivity of major lobe 22 will receive at least half the sound power as at the peak sensitivity shown at an angle of 0°. Similarly, minor lobe beam angle 30 may be defined by half power angle 32 in which minor lobe 24 exhibits at least half the sound power sensitivity as the peak value occurring at an angle of 180°. As can readily be seen, minor lobe beam angle 30 is less than major lobe beam angle 26, and major lobe 22 exhibits greater sensitivity to sound than minor lobe 24.

Typically, a microphone having hypercardioid polar response pattern 20 is aimed such that a direction of desired sound, indicated by 34, falls within major lobe beam angle 26. This provides the greatest sensitivity for receiving sound from direction 34. Any sound received from a direction within minor lobe beam angle 30, indicated by direction 36, is assumed to be noise that is attenuated by the decreased sensitivity of minor lobe 24. In the present invention, directionality is achieved by aiming minor lobe 24 in a direction 36 of desired sound. The effects of any sound received from direction 34 within the sensitivity of major lobe 22 is reduced through the use of signal processing circuitry.

As will be recognized by one of ordinary skill in the art, microphones exhibiting a wide variety of polar response patterns in addition to hypercardioid polar response pattern 20 may be used in the present invention. For example, trade-off between directionality and sensitivity may be achieved by increasing or decreasing the size of major lobe 22 relative to minor lobe 24. Also, microphones exhibiting a higher order hypercardioid polar response may be used. Such microphones may have greater distinction between major lobe 22 and minor lobe 24, may have sublobes within major lobe 22 and minor lobe 24, or may have more than two lobes. Further, any microphone exhibiting at least one minor lobe and at least one major lobe, which may be designated generally as a first lobe and a second lobe, respectively, may be used to implement the present invention.

Figure 2:
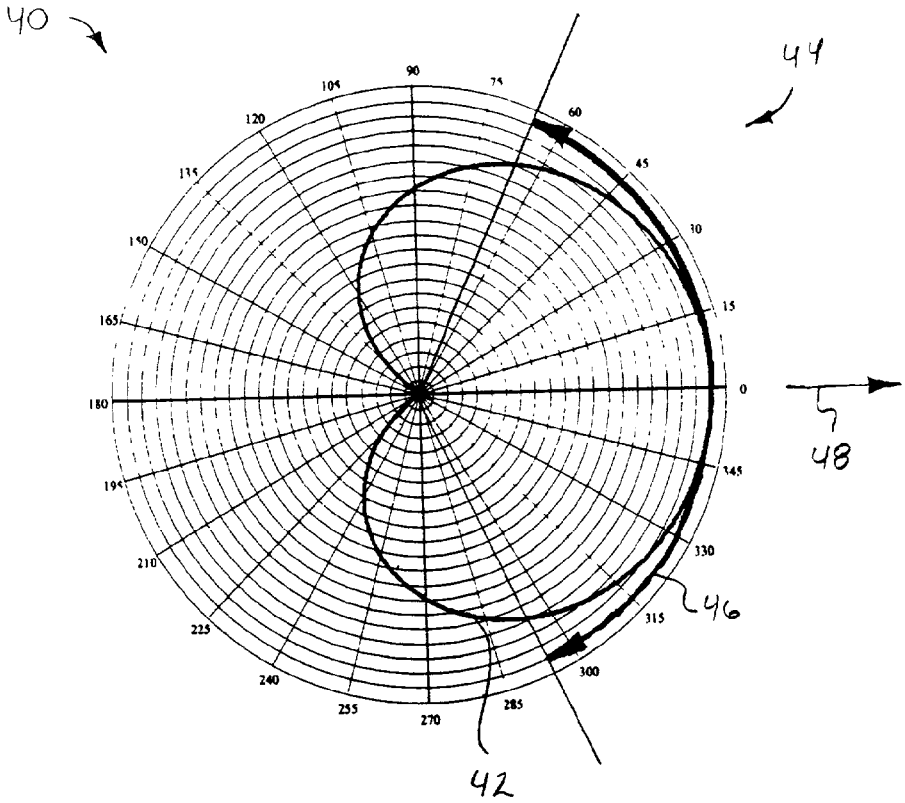
FIG. 2 is a polar response plot of a microphone cardioid response pattern.

Referring now to FIG. 2, a polar response plot of a microphone cardioid response pattern is shown. A cardioid polar response pattern, shown generally by 40, has only one lobe 42. Cardioid beam angle 44, which may be defined by half power angle 46, is greater than any beam angle 26, 30 in hypercardioid polar response pattern 20 of the same order. Cardioid polar response pattern 40 thus exhibits sensitivity to a great range of directions 48 within beam angle 44. Cardioid polar response pattern 40 represents one extreme resulting from shrinking minor lobe 24 and, consequently, beam angle 30, to zero. Thus, any polar response pattern unlike cardioid polar response pattern 40 may be referred to as a non-cardioid response pattern.

Figure 3:
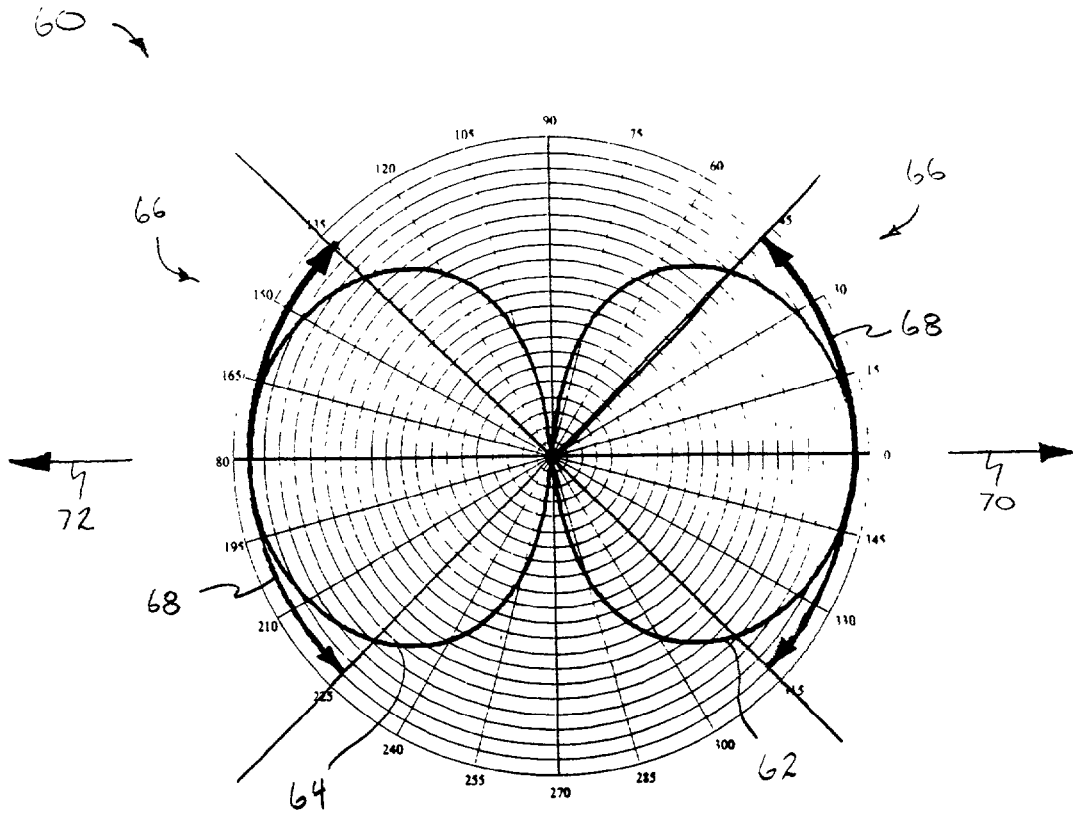
FIG. 3 is a polar response plot of a microphone balanced gradient response pattern.

Referring now to FIG. 3, a polar response plot of a microphone balanced gradient response pattern is shown. A gradient microphone has electrical responses corresponding to some function of the difference in pressure between two points in space. Gradient microphones may be implemented using two identical omnidirectional transducer elements of opposite phase. Alternatively, a gradient microphone may be implemented with a single bidirectional transducer element. Polar pattern 60 indicates a gradient microphone with first lobe 62 equal to second lobe 64. Thus, balanced gradient polar response pattern 60 has two equal but oppositely facing beam angles 66, each of which may be defined by half power angle 68. A microphone having polar response pattern 60 will thus be equally sensitive to sound from direction 70 as with sound emanating from opposite direction 72. In a balanced gradient response, selection of a major lobe and a minor lobe is arbitrary.

Balanced gradient polar response pattern 60 results mathematically from expanding minor lobe 24 in hypercardioid polar response pattern 20 to equal the size of major lobe 22. A microphone with balanced gradient polar response pattern 60 may be modified to have hypercardioid polar response 20 or cardioid polar response 40 through the addition of appropriate porting and baffling as is known in the art.

The graphs of FIG. 1-3 are idealized plots. The polar response plots of most microphones exhibit irregularities due to particular aspects of their construction. Also, directional sensitivity is typically a function of the frequency of sound being used to generate the polar plot.

Figure 4:
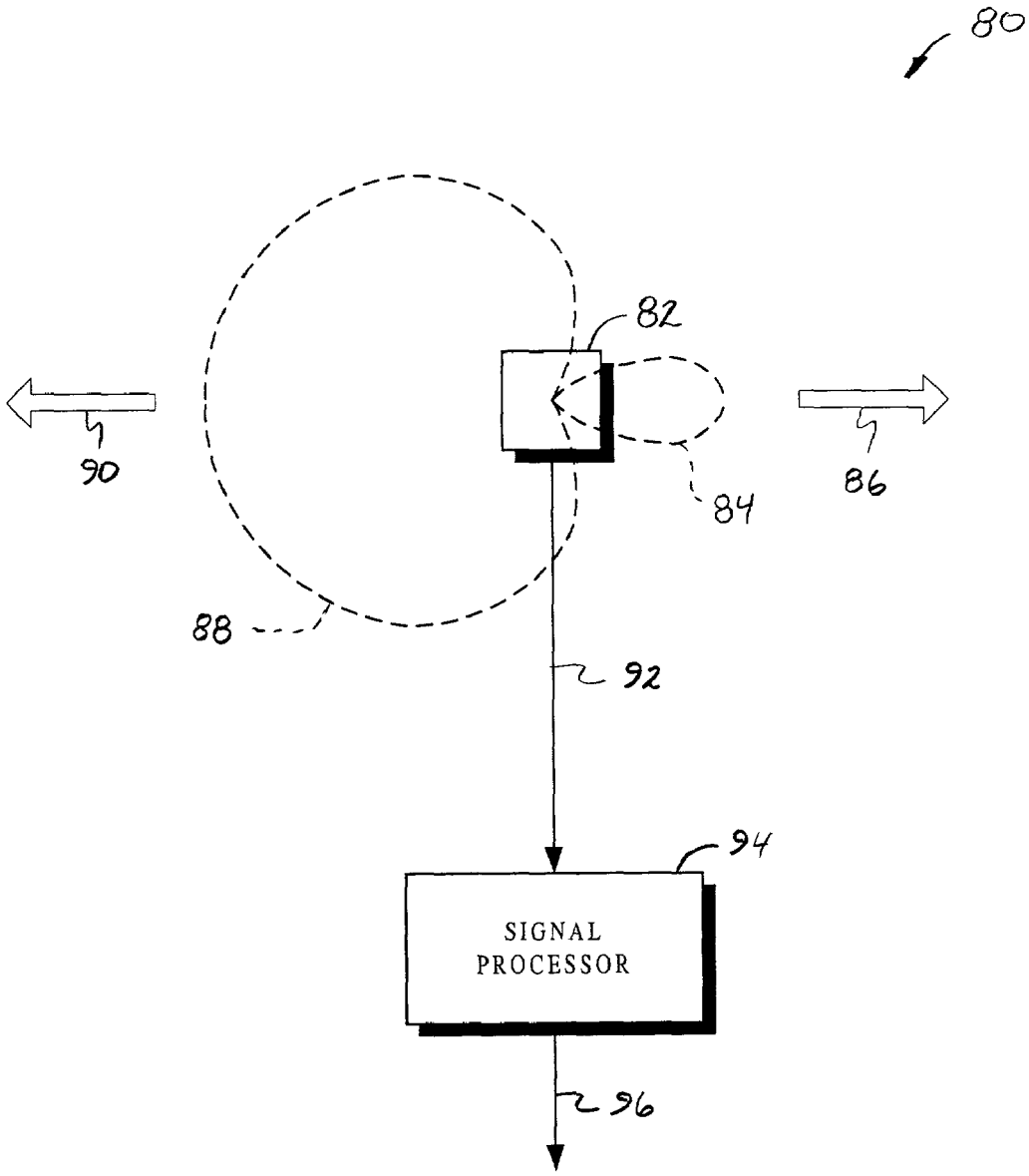
FIG. 4 is a block diagram of a directional sound acquisition system according to an embodiment of the present invention.

Referring now to FIG. 4, a block diagram of a directional sound acquisition system according to an embodiment of the present invention is shown. A directional sound acquisition system, shown generally by 80, includes microphone 82 having a directional sensitivity including first lobe 84 aimed in particular direction 86 from which sound is to be measured. The sensitivity of microphone 82 includes second lobe 88 pointed in direction 90 other than particular direction 86. First lobe 84 has less sound sensitivity than second lobe 88. As can be seen, the beam width of first lobe 84 is also less than the beam width of second lobe 88. Exploiting this narrower beam width allows greater directionality for system 80. Microphone 82 generates electrical signal 92 based on sounds sensed from directions 86 and 90. Signal processor 94 processes electrical signal 92 to extract effects of sound sensed in directions 90 from sound sensed in desired particular directions 86. Signal processor 94 then generates output signal 96 representing sound received from direction 86. Signal 96 may be stored or further processed for a variety of applications including telecommunications, speech recognition, human-machine interfaces, instrumentation, security systems, and the like.

Signal processor 94 may utilize one or more of a variety of techniques as described below. Further, signal processor 94 may be implemented through one or more of a variety of means including hardware, software, firmware, and the like. For example, signal processor 94 may be implemented by one or more of software executing on a personal computer, logic implemented on a custom fabricated or programmed integrated circuit chip, discrete analog components, discrete digital components, programs executing on one or more digital signal processors, and the like. One of ordinary skill in the art will recognize that a wide variety of implementations for signal processor 94 lie within the spirit and scope of the present invention.

Figure 5:
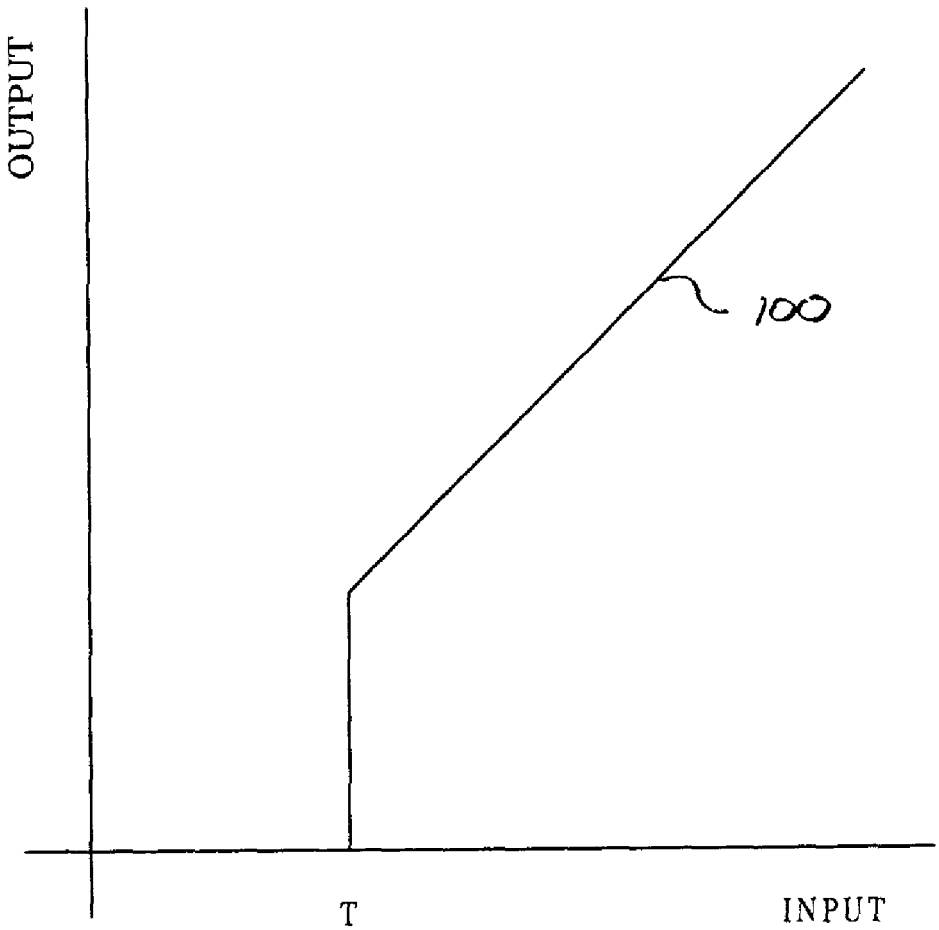
FIG. 5 is a graph illustrating threshold detection according to an embodiment of the present invention.

Referring now to FIG. 5, a graph illustrating threshold detection according to an embodiment of the present invention is shown. Curve 100 illustrates threshold detection that blocks any input signal less than a threshold value T and passes any input signal above threshold T to the output. Thus, if desired sound from particular direction 86 is louder than noise or unwanted sounds from other directions 90, thresholding indicated by graph 100 will block the unwanted sound or noise during periods of relative quiet from direction 86.

Thresholding is typically used in conjunction with other techniques to limit or reject unwanted sound. For example, thresholding may be used when the desired sound is spoken voice since spoken language has many pauses that may occur due to, for example, when the speaker breathes or listens.

Figure 6A:
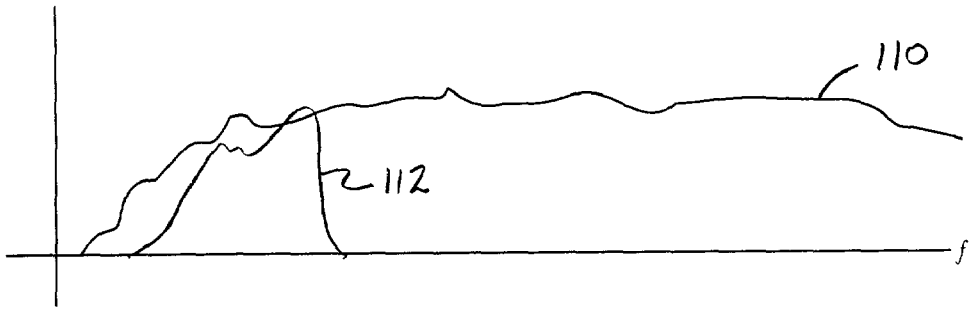
FIG. 6*a* is a frequency plot of a noise spectrum.
Figure 6B:
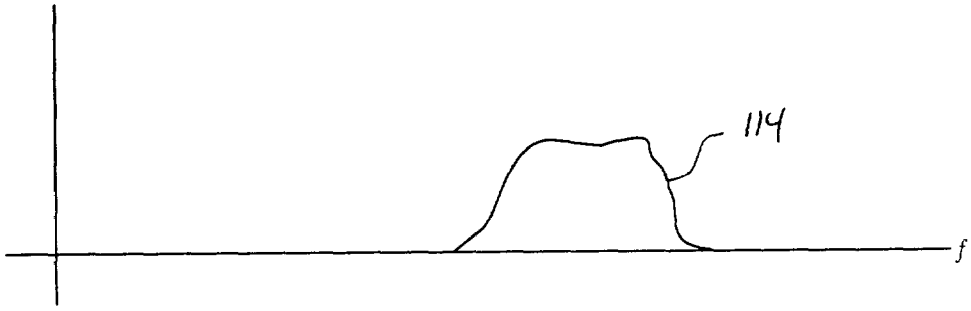
FIG. 6*b* is a frequency plot of a desired sound spectrum.
Figure 6C:
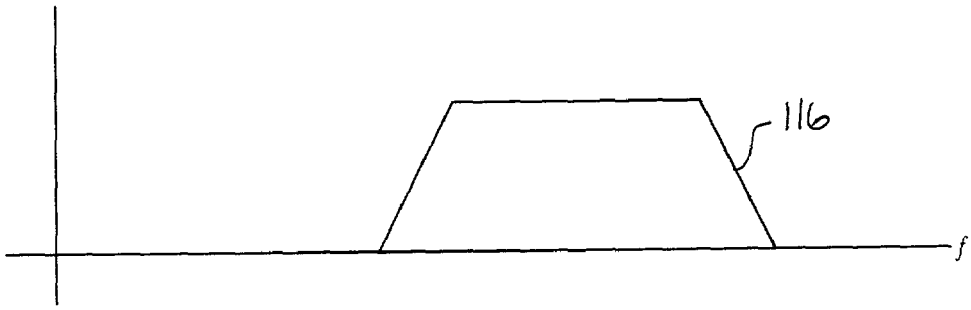
FIG. 6*c* is a frequency plot of a filter for extracting a desired sound according to an embodiment of the present invention.

Referring now to FIGS. 6*a*–6*c*, frequency plots illustrating spectral filtering according to an embodiment of the present invention are shown. In FIG. 6*a*, unwanted sound from direction 90 received by second lobe 88 may include a wideband noise source such as illustrated by frequency plot 110. Unwanted sound may also consist of sources generating frequency components within a relative narrow band such as illustrated by frequency plot 112. Such unwanted sound may also be considered as noise with regards to a particular desired sound.

The spectrum of a desired sound received from direction 86 by first lobe 84 is illustrated by frequency plot 114 in FIG. 6*b*. In this case, the range of desired frequencies in plot 114 span only a limited region of wideband spectrum 110 or do not significantly overlap unwanted sound spectrum 112. A filter, such as shown by frequency response plot 116 in FIG. 6*c*, may be implemented to pass the spectral components of desired sound spectrum 114 while rejecting those of unwanted sound spectrum 112 or reducing the effects of wideband noise spectrum 110. Filter 116 may be a high pass, low pass, band pass, or band reject filter implemented using either analog or digital electronics or as an executing program as is known in the art.

Many other frequency-based techniques are available. For example, spectral subtraction is used to recover speech by suppressing background noise. Background noise spectral energy is estimated during periods when speech is not detected. The noise spectral energy is then subtracted from the received signal. Speech may be detected with a cepstral detector. Various types of cepstral detectors are known, such as those based on fast Fourier transform (FFT) or based on autoregressive techniques.

Figure 7:
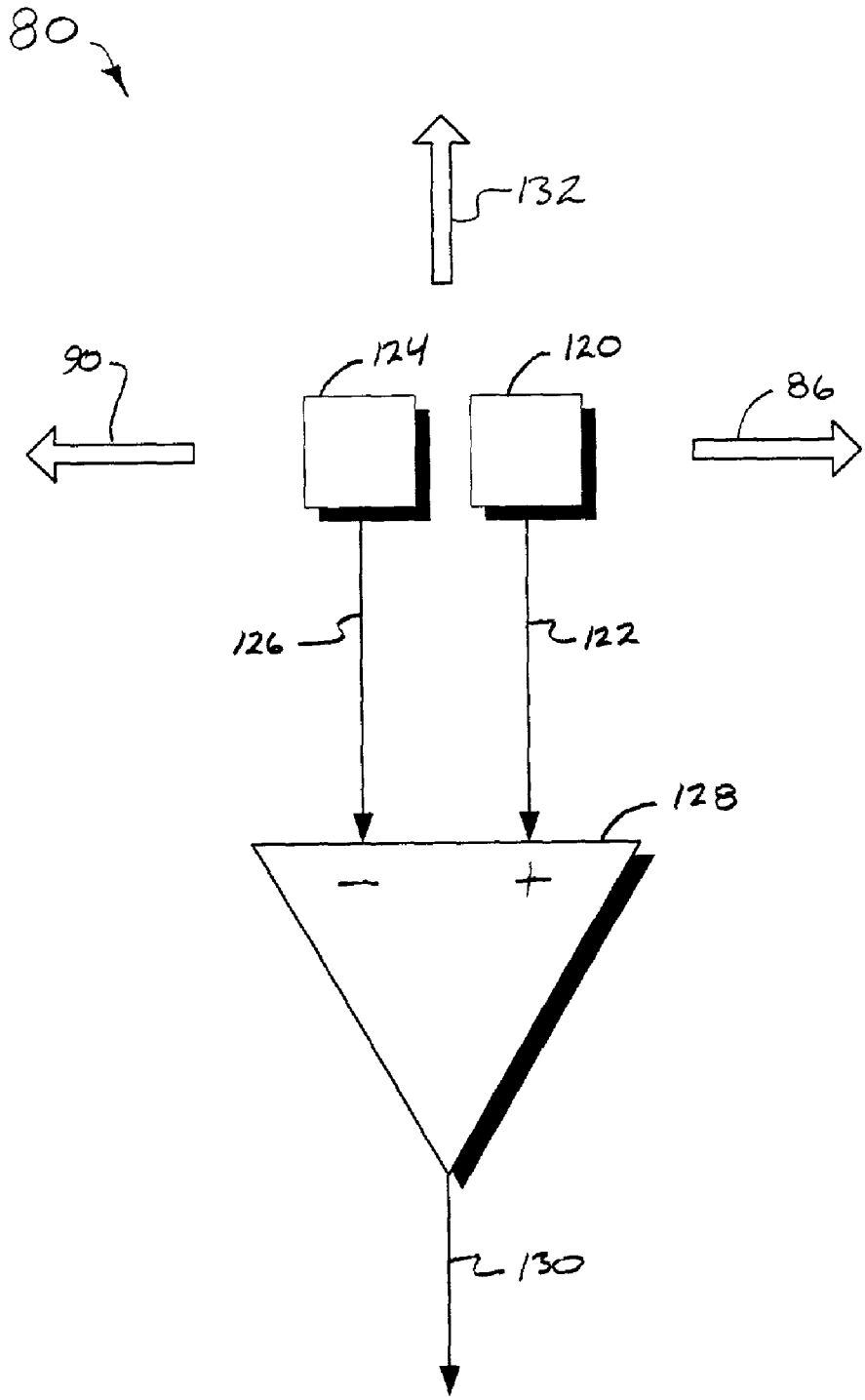
FIG. 7 is a block diagram of spatial or gradient noise cancellation according to an embodiment of the present invention.

Referring now to FIG. 7, a block diagram of spatial or gradient noise cancellation according to an embodiment of the present invention is shown. Directional sound acquisition system 80 includes first sensor 120 generating electrical signal 122 in response to received sound and second sensor 124 generating electrical signal 126 in response to sensed sound. Sensors 120, 124 may be elements of the same microphone or separate microphones. Electrical signals 122, 126 are received by differencing circuit 128 which generates output 130 based on subtracting signal 126 from signal 122.

Gradient noise cancellation, also known as active noise cancellation, uses signals 122,126 from two out-of-phase sensors 120,124 to reduce the effect of any sound received from direction 132 generally normal to an axis between sensors 120,124. In spatial noise cancellation, general background noise received from directions 90,132 equally well by both sensors 120,124 are cancelled. Sound from direction 86, which is received by sensor 120 with greater strength than by sensor 124, is not severely reduced by differencer 128.

Figure 8:
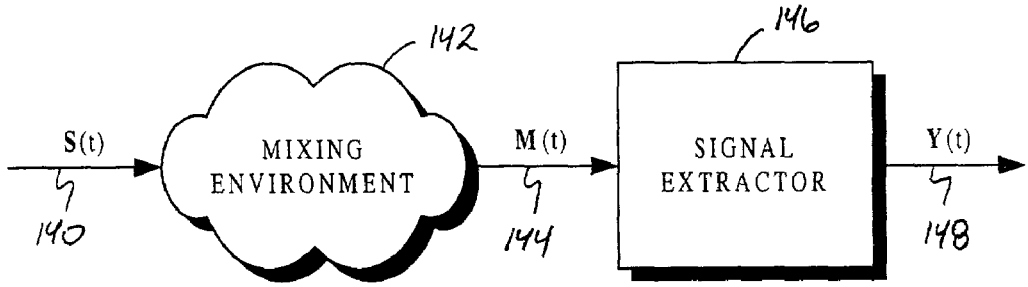
FIG. 8 is a block diagram of signal separation according to an embodiment of the present invention.

Referring now to FIG. 8, a block diagram of signal separation according to an embodiment of the present invention is shown. Signal separation permits one or more signals, received by one or more sound sensors, to be separated from other signals. Signal sources 140 indicated by s(t), represents a collection of source signals which are intermixed by mixing environment 142 to produce mixed signals 144, indicated by m(t). Signal extractor 146 extracts one or more signals from mixed signals 144 to produce separated signals 148 indicated by y(t).

Many techniques are available for signal separation. One set of techniques is based on neurally inspired adaptive architectures and algorithms. These methods adjust multiplicative coefficients within signal extractor 146 to meet some convergence criteria. Conventional signal processing approaches to signal separation may also be used. Such signal separation methods employ computations that involve mostly discrete signal transforms and filter/transform function inversion. Statistical properties of signals 140 in the form of a set of cumulants are used to achieve separation of mixed signals where these cumulants are mathematically forced to approach zero.

Mixing environment 142 may be mathematically described as follows:

$$\dot{\overline{X}}=\overline{A}\overline{X}+\overline{B}s$$

$$m=\overline{C}\overline{X}+\overline{D}s$$

where $\overline{A}$, $\overline{B}$, $\overline{C}$ and $\overline{D}$ are parameter matrices and $\overline{X}$ represents continuous-time dynamics or discrete-time states. Signal extractor 146 may then implement the following equations:

$$\dot{X}=AX+Bm$$

$$y=CX+Dm$$

where y is the output, X is the internal state of signal extractor 146, and A, B, C and D are parameter matrices.

Figure 9A:
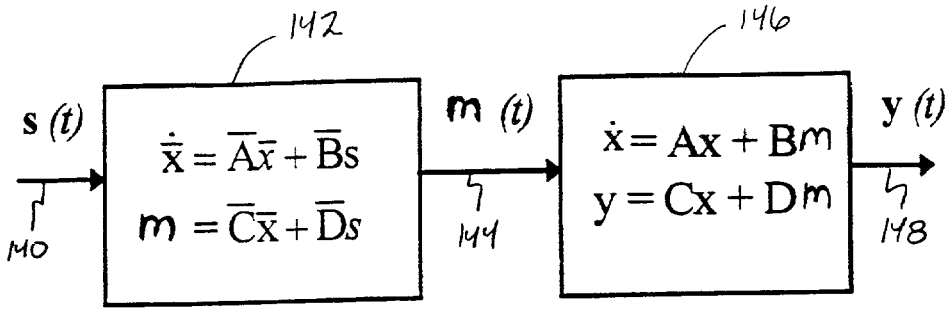
FIG. 9*a* is a block diagram of a feedforward signal separation architecture.
Figure 9B:
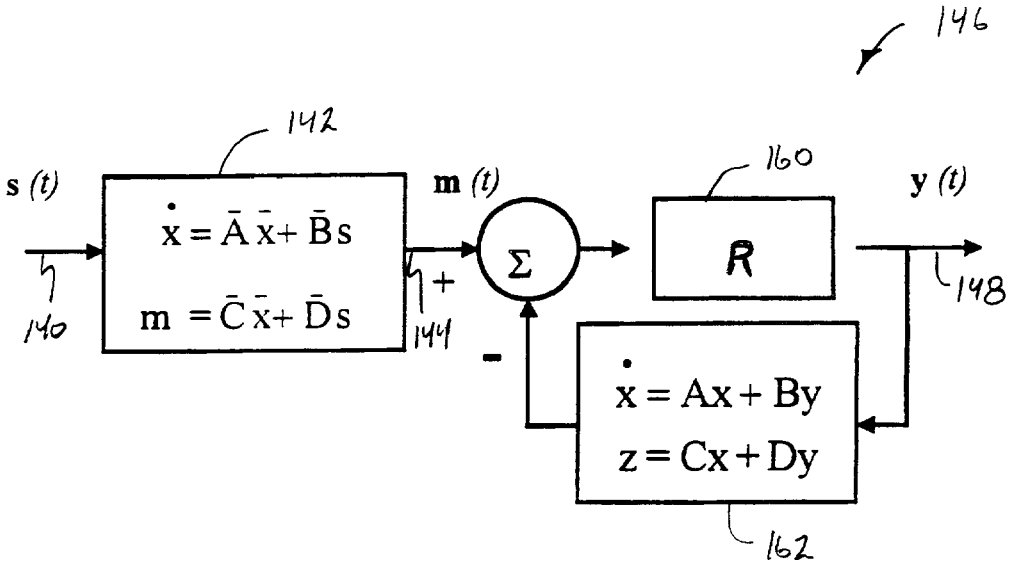
FIG. 9*b* is a block diagram of a feedback signal separation architecture.

Referring now to FIGS. 9*a* and 9*b*, block diagrams illustrating state space architectures for signal mixing and signal separation are shown. FIG. 9*a* illustrates a feedforward signal extractor architecture 146. FIG. 9*b* illustrates a feedback signal extractor architecture 146. The feedback architecture leads to less restrictive conditions on parameters of signal extractor 146. Feedback also introduces several attractive properties including robustness to errors and disturbances, stability, increased bandwidth, and the like. Feedforward element 160 in feedback signal extractor 146 is represented by R which may, in general, represent a matrix or the transfer function of a dynamic model. If the dimensions of m and y are the same, R may be chosen to be the identity matrix. Note that parameter matrices A, B, C and D in feedback element 162 do not necessarily correspond with the same parameter matrices in the feedforward system.

The mutual information of a random vector y is a measure of dependence among its components and is defined as follows:

$$L(y)=\sum_{y\in y}p_y(y)\ln\left|\frac{p_y(y)}{\prod_{j=l}^{j=r}p_{y_j}(y_j)}\right|$$

An approximation of the discrete case is as follows:

$$L(y)\cong\sum_{k=k_0}^{k_l}p_y(y(k))\ln\left|\frac{p_y(y(k))}{\prod_{j=l}^{j=r}p_{y_j}(y_j(k))}\right|$$

where $p_y(y)$ is the probability density function of the random vector y and $p_{y_j}(y_j)$ is the probability density of the $j^{th}$ component of the output vector y. The functional L(y) is always non-negative and is zero if and only if the components of the random vector y are statistically independent. This measure defines the degree of dependence among the components of the signal vector. Therefore, it represents an appropriate function for characterizing a degree of statistical independence. L(y) can be expressed in terms of the entropy:

$$L(y)=-H(y)+\sum_i H(y_i)$$

where H(•) is the entropy of y defined as $H(y)=-E[\ln f_y]$ and E[•] denotes the expected value.

Mixing environment 142 can be modeled as the following nonlinear discrete-time dynamic (forward) processing model:

$$X_p(k+1)=f_p^k(X_p(k),s(k),w_1^*)$$

$$m(k)=g_p^k(X_p(k),s(k),w_2^*)$$

where s(k) is an n-dimensional vector of original sources, m(k) is the m-dimensional vector of measurements and $X_p(k)$ is the $N_p$-dimensional state vector. The vector (or matrix) $w_1^*$ represents constants or parameters of the dynamic equation and $w_2^*$ represents constants or/parameters of the output equation. The functions $f_p(\bullet)$ and $g_p(\bullet)$ are differentiable. It is also assumed that existence and uniqueness of solutions of the differential equation are satisfied for each set of initial conditions $X_p(t_0)$ and a given waveform vector s(k).

Signal extractor 146 may be represented by a dynamic forward network or a dynamic feedback network. The feedforward network is:

$$X(k+1)=f^k(X(k),m(k),w1)$$

$$y(k)=g^k(X(k),m(k),w2)$$

where k is the index, m(k) is the m-dimensional measurement, y(k) is the r-dimensional output vector, X(k) is the N-dimensional state vector. Note that N and $N_p$ may be different. The vector (or matrix) $w_1$ represents the parameter of the dynamic equation and the vector (or matrix) $w_2$ represents the parameter of the output equation. The functions f(•) and g(•) are differentiable. It is also assumed that existence and uniqueness of solutions of the differential equation are satisfied for each set of initial conditions $X(t_0)$ and a given measurement waveform vector m(k).

The update law for dynamic environments is used to recover the original signals. Environment 142 is modeled as a linear dynamical system. Consequently, signal extractor 146 will also be modeled as a linear dynamical system.

In the case where signal extractor 146 is a feedforward dynamical system, the performance index may be defined as follows:

$$J_0(w_1, w_2) = \sum_{k=k_0}^{k_1-1} L^k(y_k)$$

subject to the discrete-time nonlinear dynamic network $$X_{k+1} = f^k(X_k, m_k, w_1),\ X_{k_0}$$

$$y_k = g^k(X_k, m_k, w_2)$$

This form of a general nonlinear time varying discrete dynamic model includes both the special architectures of multilayered recurrent and feedforward neural networks with any size and any number of layers. It is more compact, mathematically, to discuss this general case. It will be recognized by one of ordinary skill in the art that it may be directly and straightforwardly applied to feedforward and recurrent (feedback) models.

The augmented cost function to be optimized becomes:

$$J_0'(w_1, w_2) = \sum_{k=k_0}^{k_1-1} L^k(y_k) + \lambda_{k+1}^T(f^k(X_k, m_k, w_1) - X_{k+1})$$

The Hamiltonian is then defined as:

$$H^k=L^k(y(k))+\lambda_{k+1}{}^T f^k(X,\ m,\ w_1)$$

Consequently, the necessary conditions for optimality are:

$$X_{k+1} = \frac{\partial H^k}{\partial \lambda_{k+1}} = f^k(X_k, m_k, w_1)$$

$$\lambda_k = \frac{\partial H^k}{\partial X_k} = (f_{X_k}^k)^T \lambda_{k+1} + \frac{\partial L^k}{\partial X_k}$$

$$\Delta w_2 = -\eta \frac{\partial H^k}{\partial w_2} = -\eta \frac{\partial L^k}{\partial w_2}$$

$$\Delta w_1 = -\eta \frac{\partial H^k}{\partial w_1} = -\eta (f_{w_1}^k)^T \lambda_{k+1}$$

The boundary conditions are as follows. The first equation, the state equation, uses an initial condition, while the second equation, the co-state equation, uses a final condition equal to zero. The parameter equations use initial values with small norm which may be chosen randomly or from a given set.

In the general discrete linear dynamic case, the update law is then expressed as follows:

$$X_{k+1} = \frac{\partial H^k}{\partial \lambda_{k+1}} = f^k(X, m, w_1) = AX_k + Bm_k$$

$$\lambda_k = \frac{\partial H^k}{\partial X_k} = (f_{X_k}^k)^T \lambda_{k+1} + \frac{\partial L^k}{\partial X_k} = A_k^T \lambda_k + C_k^T \frac{\partial L^k}{\partial y_k}$$

$$\Delta A = -\eta \frac{\partial H^k}{\partial A} = -\eta (f_A^k)^T \lambda_{k+1} = -\eta \lambda_{k+1} X_k^T$$

$$\Delta B = -\eta \frac{\partial H^k}{\partial B} = -\eta (f_B^k)^T \lambda_{k+1} = -\eta \lambda_{k+1} m_k^T$$

$$\Delta D = -\eta \frac{\partial H^k}{\partial D} = -\eta \frac{\partial L^k}{\partial D} = \eta([D]^{-T} - f_a(y) m^T)$$

$$\Delta C = -\eta \frac{\partial H^k}{\partial C} = -\eta \frac{\partial L^k}{\partial C} = \eta(-f_a(y) X^T)$$

The general discrete-time linear dynamics of the network are given as:

$$X(k+1)=AX(k)+Bm(k)$$

$$y(k)=CX(k)+Dm(k)$$

where m(k) is the m-dimensional vector of measurements, y(k) is the n-dimensional vector of processed outputs, and X(k) is the (mL) dimensional states (representing filtered versions of the measurements in this case). One may view the state vector as composed of the L m-dimensional state vectors $X_1, X_2, \ldots, X_L$. That is, $$X_k = X(k) = \begin{bmatrix} X_1(k) \\ X_2(k) \\ \cdots \\ X_L(k) \end{bmatrix}$$

In the case where the matrices and A and B are in the controllable canonical form, the A and B block matrices may be represented as:

$$A = \begin{bmatrix} A_{11} & A_{12} & \cdots & A_{1L} \\ I & 0 & \cdots & 0 \\ \cdots & I & \cdots & 0 \\ 0 & 0 & I & 0 \end{bmatrix}, \text{ and } B = \begin{bmatrix} I \\ 0 \\ \cdots \\ 0 \end{bmatrix}$$

where each block sub-matrix $A_{Ij}$ may be simplified to a diagonal matrix, and each I is a block identity matrix with appropriate dimensions.

Then:

$$X_1(k+1) = \sum_{j=1}^{L} A_{1j} X_j(k) + m(k)$$

$$X_2(k+1) = X_1(k)$$

$$\dots$$

$$X_L(k+1) = X_{L-1}(k)$$

This model represents an IIR filtering structure of the measurement vector m(k). In the event that the block matrices $A_{Ij}$ are zero, the model is reduced $$y(k) = \sum_{j=1}^{L} C_j X_j(k) + Dm(k)$$

to the special case of an FIR filter.

$$X_1(k+1) = m(k)$$
$$X_2(k+1) = X_1(k)$$
$$\dots$$
$$X_L(k+1) = X_{L-1}(k)$$
$$y(k) = \sum_{j=1}^{L} C_j X_j(k) + Dm(k)$$

The equations may be rewritten in the well-known FIR form:

$$X_1(k) = m(k-1)$$
$$X_2(k) = X_1(k-1) = m(k-2)$$
$$\dots$$
$$X_L(k) = X_{L-1}(k-1) = m(k-L)$$
$$y(k) = \sum_{j=1}^{L} C_j X_j(k) + Dm(k)$$

This equation relates the measured signal m(k) and its delayed versions represented by $X_j(k)$, to the output y(k).

The matrices A and B are best represented in the controllable canonical forms or the form I format. Then B is constant and A has only the first block rows as parameters in the IIR network case. Thus, no update equations for the matrix B are used and only the first block rows of the matrix A are updated. Thus, the update law for the matrix A is as follows:

$$\Delta A_{1j} = -\eta \frac{\partial H^k}{\partial A_{1j}} = -\eta \left(f^k_{A_{1j}}\right)^T \lambda_{k+1} = -\eta \lambda_1(k+1) X_j^T(k)$$

Noting the form of the matrix A, the co-state equations can be expanded as:

$$\lambda_1(k) = \lambda_2(k+1) + C_1^T \frac{\partial L^k}{\partial y_k}(k)$$

$$\lambda_2(k) = \lambda_3(k+1) + C_2^T \frac{\partial L^k}{\partial y_k}(k)$$

$$\vdots$$

$$\lambda_L(k) = C_L^T \frac{\partial L^J}{\partial y_k}(k)$$

$$\lambda_1(k+1) = \sum_{l=1}^{L} C_l^T \frac{\partial L^k}{\partial y_k}(k+l)$$

Therefore, the update law for the block sub-matrices in A are:

$$\Delta A_{1j} = -\eta \frac{\partial H^k}{\partial A_{1j}} = -\eta \lambda_1(k+1) X_j^T(K) = -\eta \sum_{l=1}^{L} C_l^T \frac{\partial l^k}{\partial y_k}(k+l) X_j^T$$

The update laws for the matrices D and C can be expressed as follows:

$$\Delta D = \eta([D]^{-T} - f_a(y) m^T) = \eta(I - f_a(y)(Dm)^T)[D]^{-T}$$

where I is a matrix composed of the r×r identity matrix augmented by additional zero row (if n>r) or additional zero columns (if n<r) and $[D]^{-T}$ represents the transpose of the pseudo-inverse of the D matrix.

For the C matrix, the update equations can be written for each block matrix as follows:

$$\Delta C_j = -\eta \frac{\partial H^k}{\partial C_j} = -\eta \frac{\partial L^k}{\partial C_j} = \eta(-f_a(y) X_j^T)$$

Other forms of these update equations may use the natural gradient to render different representations. In this case, no inverse of the D matrix is used, however, the update law for ΔC becomes more computationally demanding.

If the state space is reduced by eliminating the internal state, the system reduces to a static environment where:

$$m(t) = \overline{D} S(t)$$

In discrete notation, the environment is defined by:

$$m(k) = \overline{D} S(k)$$

Two types of discrete networks have been described for separation of statically mixed signals. These are the feedforward network, where the separated signals y(k) are $$y(k) = WM(k)$$

and feedback network, where y(k) is defined as:

$$y(k) = m(k) - Dy(k)$$

$$y(k) = (I+D)^{-1} m(k)$$

In case of the feedforward network, the discrete update laws are as follows:

$$W^{\tau+1} = W^1 + \mu\{-f(y(k)) g^T(y(k)) + \alpha I\}$$

and in case of the feedback network, $$D^{t+1}=D^t+\mu\{f(y(k))g^T(y(k))-\alpha I\}$$

where ($\alpha$I) may be replaced by time windowed averages of the diagonals of the f(y(k)) $g^T$(y(k)) matrix. Multiplicative weights may also be used in the update.

Figure 10:
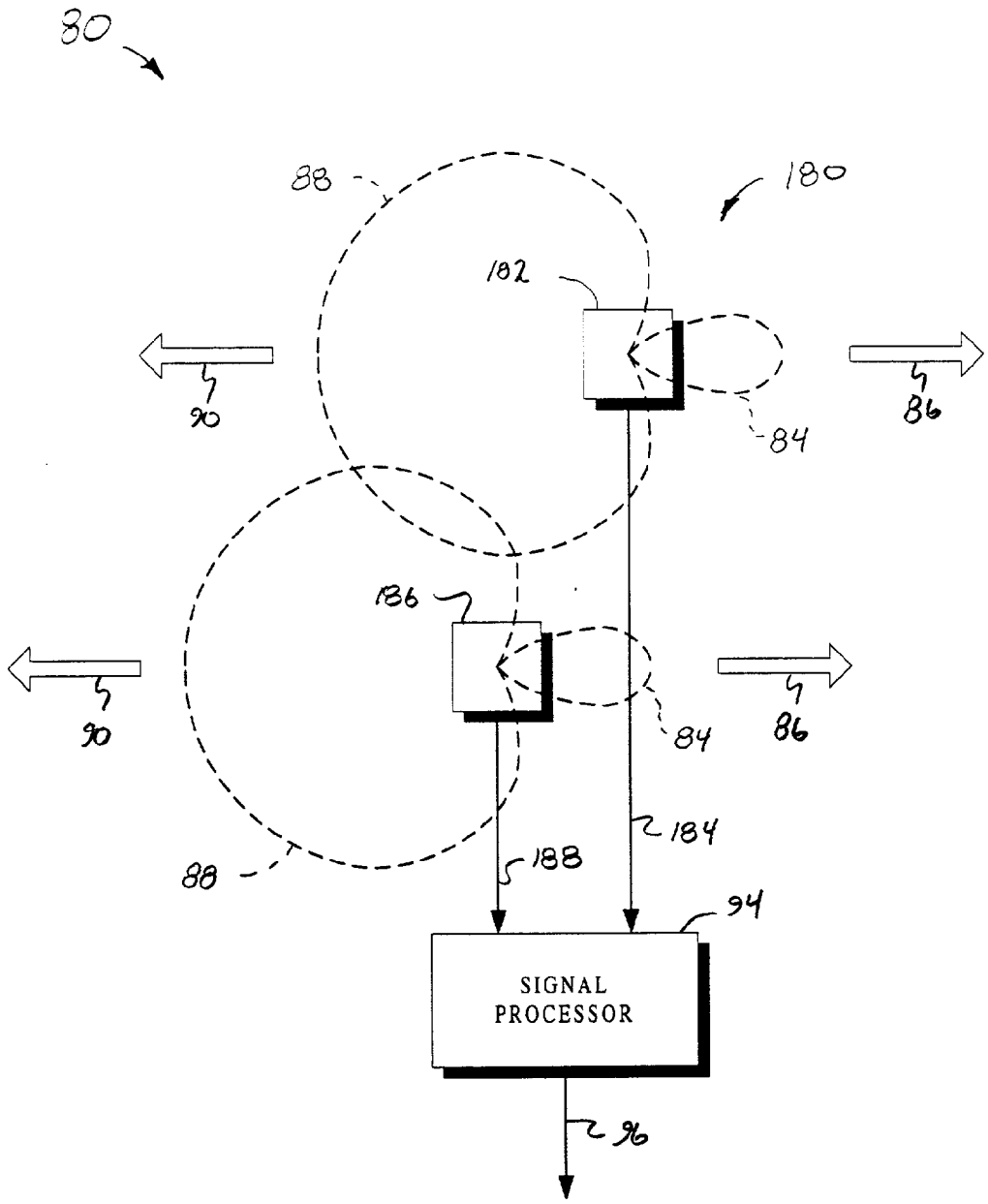
FIG. 10 is a block diagram of a dual microphone directional sound acquisition system according to an embodiment of the present invention.

Referring now to FIG. 10, a block diagram of a dual microphone directional sound acquisition system according to an embodiment of the present invention is shown. Directional sound acquisition system 80 includes microphone pair 180 having first microphone 182 generating first electrical signal 184 and second microphone 186 generating second electrical signal 188. In the embodiment shown, microphones 182, 186 are pointing to receive desired sound from direction 86. This sound may be mixed with unwanted sound or noise such as may be received from direction 90 defined by second lobe 88. Electrical signals 184, 188 are received by signal processor 94 to extract source sound information from the desired sound in direction 86 from amongst sound from other sources. Signal processor 94 may generate output 96 representing the extracted sound information.

In an embodiment of the present invention, microphones 182, 186 are spaced such that sound from a particular source, such as desired sound from direction 86, strikes each microphone 182, 186 at a different time. Thus, a fixed sound source is registered to different degrees by microphones 182, 186. In particular, the closer a source is to one microphone, the greater will be the relative output generated. Further, due to the distance between microphones 182, 186, a sound wave front emanating from a source arrives at each microphone 182, 186 at different times. In many real environments, multiple paths are created from a sound to microphones 182, 186, further creating multiple delayed versions of each sound signal. Signal processor 94 may then determine between signal sources based on intermicrophone differentials in signal amplitude and on statistical properties of independent signal sources.

A dual microphone according to an embodiment of the present invention may be constructed from a model V2 available from MWM Acoustics of Indianapolis, Ind. The V2 contains two hypercardioid electret "microphones," each with the major lobe pointing in the direction of sound reception. By removing and rotating each element so that the hypercardioid minor lobe is pointing in desired direction 86, a dual microphone for use in the present invention can be created. The resulting dual microphone includes a pair of microphones 182, 186 collinearly aligned in the particular direction 86.

Figure 11:
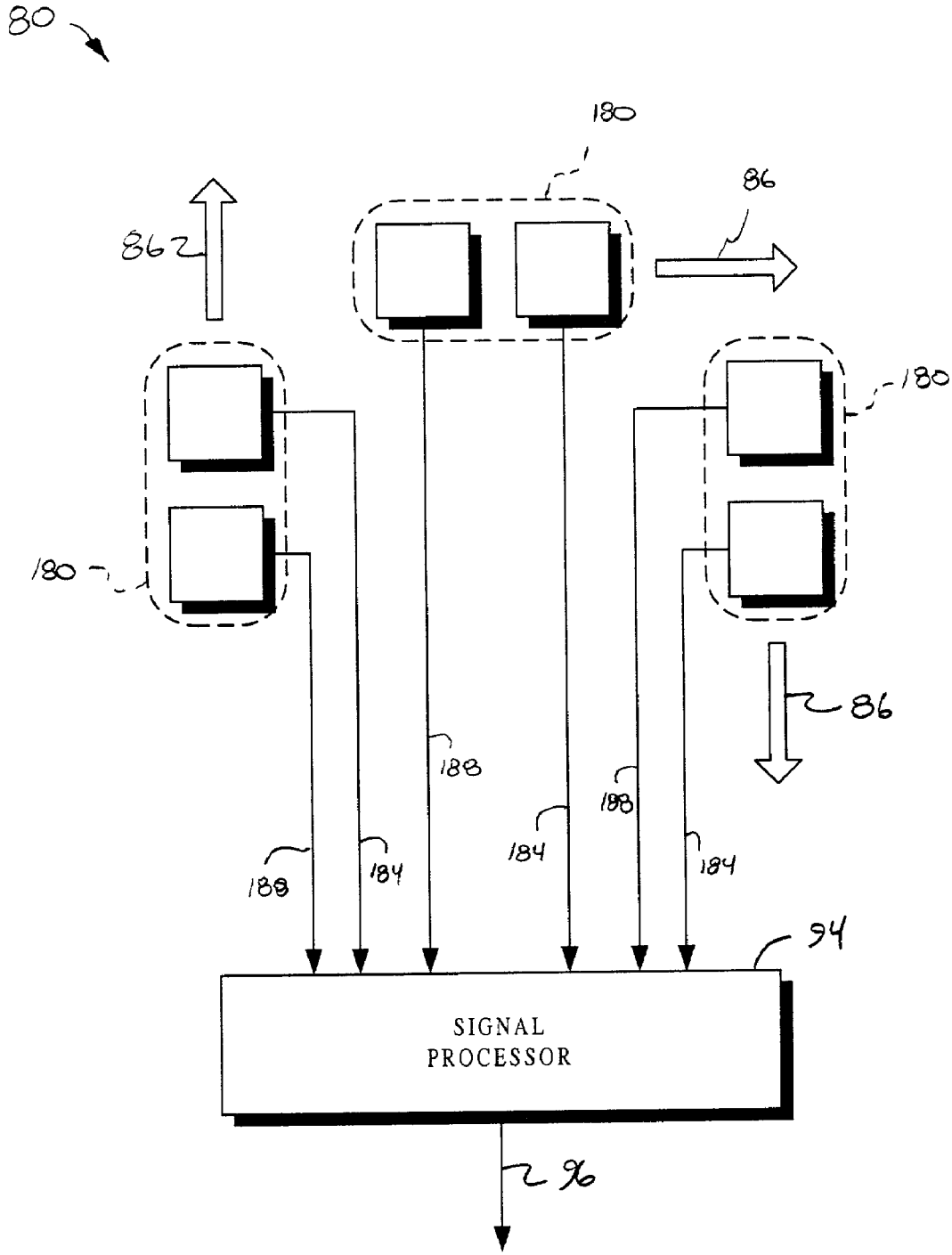
FIG. 11 is a block diagram of a directional sound acquisition system having a plurality of microphone pairs according to an embodiment of the present invention.

Referring now to FIG. 11, a block diagram of a directional sound acquisition system having a plurality of microphone pairs according to an embodiment of the present invention is shown. Directional sound acquisition system 80 may include more than one microphone pair 180. These pairs may be focused in generally the same direction or, as is shown in FIG. 11, may be aimed in different directions. Signal processor 94 accepts signals 184, 188 from each microphone pair to generate output 96 which may include sound information from each microphone pair 180.

Figure 12:
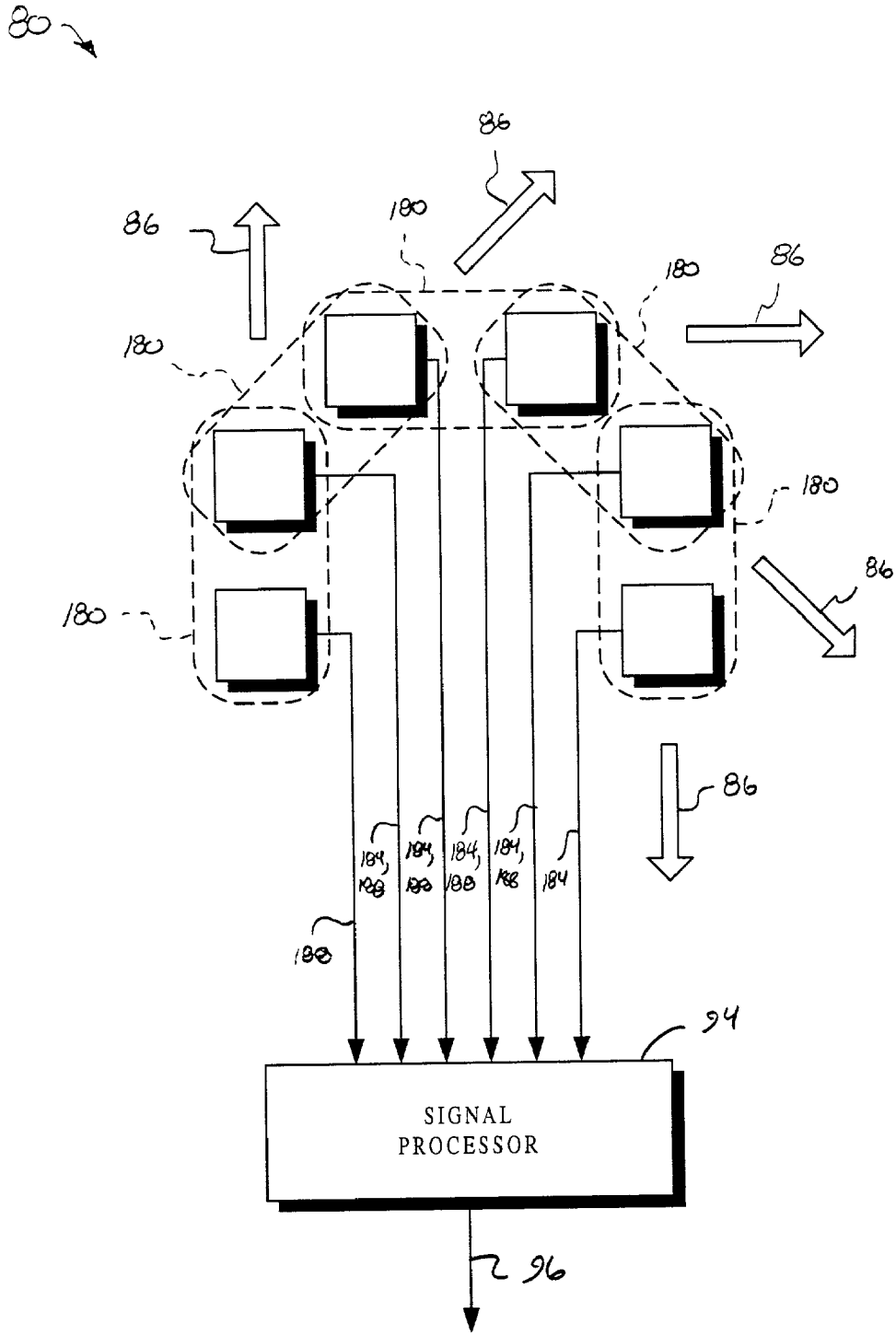
FIG. 12 is a block diagram of an alternative directional sound acquisition system having a plurality of microphone pairs according to an embodiment of the present invention.

Referring now to FIG. 12, a block diagram of an alternative directional sound acquisition system having a plurality of microphones according to an embodiment of the present invention is shown. In this embodiment, directional sound acquisition system 80 includes a plurality of microphone pairs 180, each pair sharing at least one microphone with another pair 180. In such an embodiment, each microphone in a given pair 180 may be aimed in a slightly different direction. Thus, a high degree of directional sensitivity in a plurality of directions can be obtained.

Figure 13:
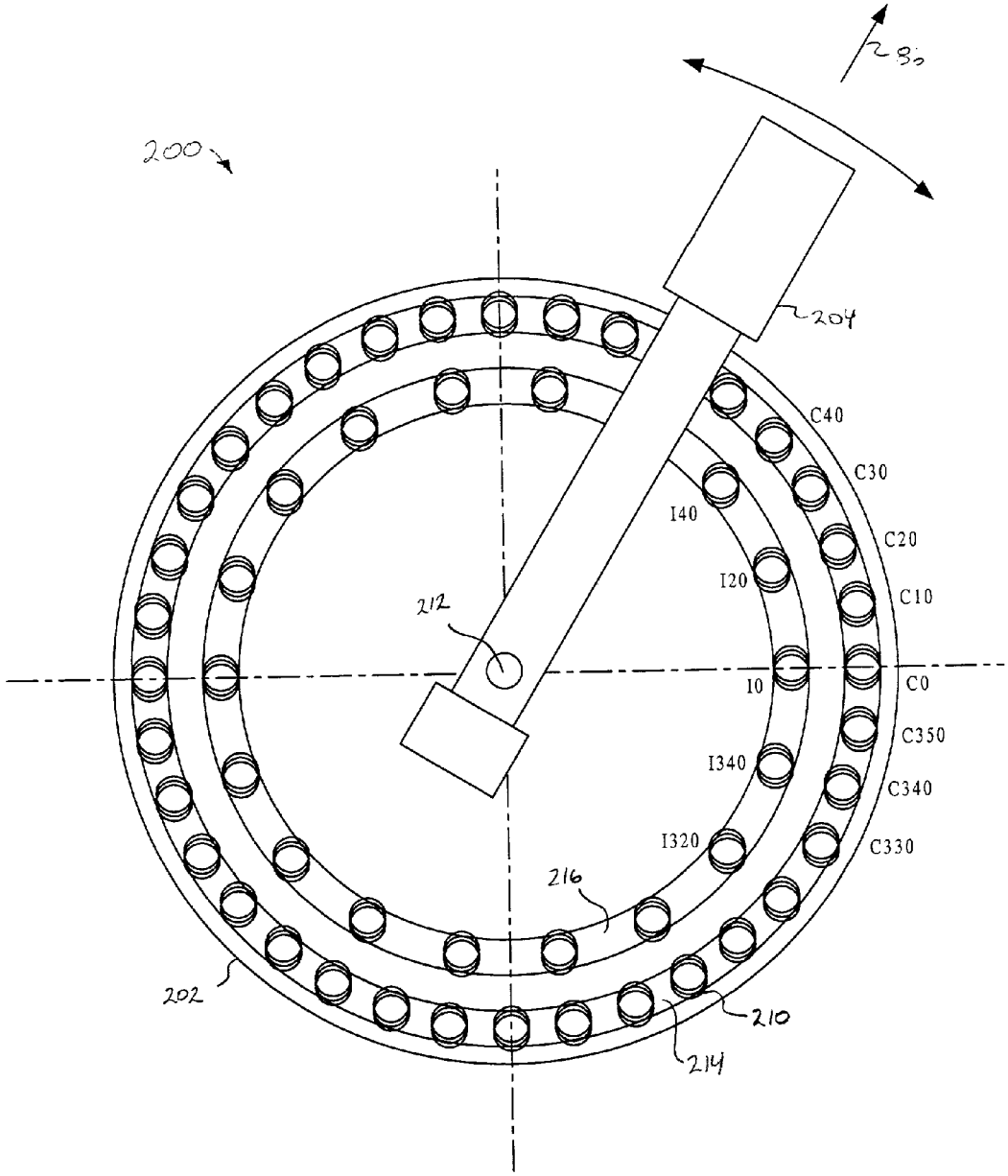
FIG. 13 is a schematic diagram of an arrangement of magnetic coils for mechanically positioning a directional microphone according to an embodiment of the present invention.
Figure 14:
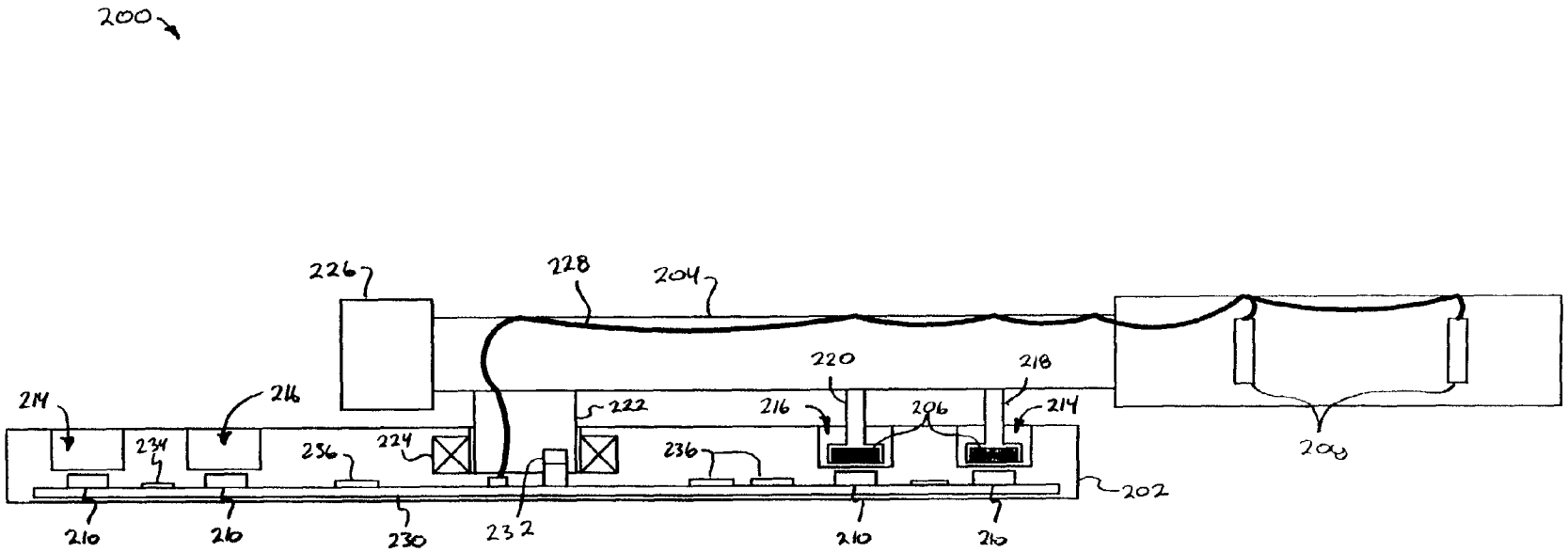
FIG. 14 is a schematic diagram of a mechanically positionable directional microphone according to an embodiment of the present invention.

Referring now to FIG. 13, a schematic diagram of an arrangement of magnetic coils for mechanically positioning a directional microphone, and to FIG. 14, a schematic diagram of a mechanically positionable directional microphone, a pointable directional microphone system according to an embodiment of the present invention is shown. A sound acquisition system, shown generally by 200, includes base 202 to which housing 204 is rotatively attached. Housing 204 includes at least one magnet 206 facing base 202. Magnet 206 may be either a permanent magnet or an electromagnet. Housing 204 further includes at least one microphone 208 such as, for example, the model M118HC electret hypercardioid element from MWM Acoustics of Indianapolis, Ind. Other types of microphone 208, with any directional response pattern, may be used. Magnetic coils 210 are disposed within base 202. Energizing at least one coil 210 creates magnetic interaction with at least one magnet 206 to rotatively position microphone 208 relative to base 202.

In the embodiment shown, magnetic coils 210 are arranged in a circular pattern about housing pivot point 212. Thirty six magnetic coils, designated C0, C10, C20, . . . C350, are spaced at ten degree intervals in outer slot 214 formed in base 202. Eighteen magnetic coils, designated I0, I20, I40, . . . I340, are spaced at twenty degree intervals in inner slot 216 formed in base 202. Housing 204 includes outer arm 218 which holds a first magnet 206 in outer slot 214. Housing 204 also includes inner arm 220 which holds a second magnet 206 in inner slot 216. Any number of coils or slots may be used. Also, slot 214, 216 need not form a circle. Slot 214 may form any portion of a circle or other curvilinear pattern.

Housing 204 includes shaft 222 which is rotatably mounted in base 202 using bearing 224. Housing 204 may also include counterweight 226 to balance housing 204 about pivot point 212. Housing 204 and shaft 222 are hollow, permitting cabling 228 to route between microphones 208 and printed circuit board 230 in base 202. In this embodiment, the rotation of housing 204 may be limited, either mechanically or in control circuitry for coils 210, to slightly greater than 360° to avoid damaging cabling 228. Many other alternatives exist for handling electrical signals generated by microphones 208. For example microphone signals may be transmitted out of housing 204 using radio or infrared signaling. Power to drive electronics in housing 204 may be supplied by battery or by slip rings interfacing housing 204 and base 202.

If closed loop control of the position of shaft 222 is desired, the position of shaft 222 may be monitored using rotational position sensor 232 connected to printed circuit board 230. Various types of rotational sensors 232 are known, including optical, hall effect, potentiometer, mechanical, and the like. Printed circuit board 230 may also include various additional components such as coils 210, drivers 234 for powering coils 210, electronic components 236 for implementing signal processor 94 and control logic for coils 210, and the like.

Figure 15:
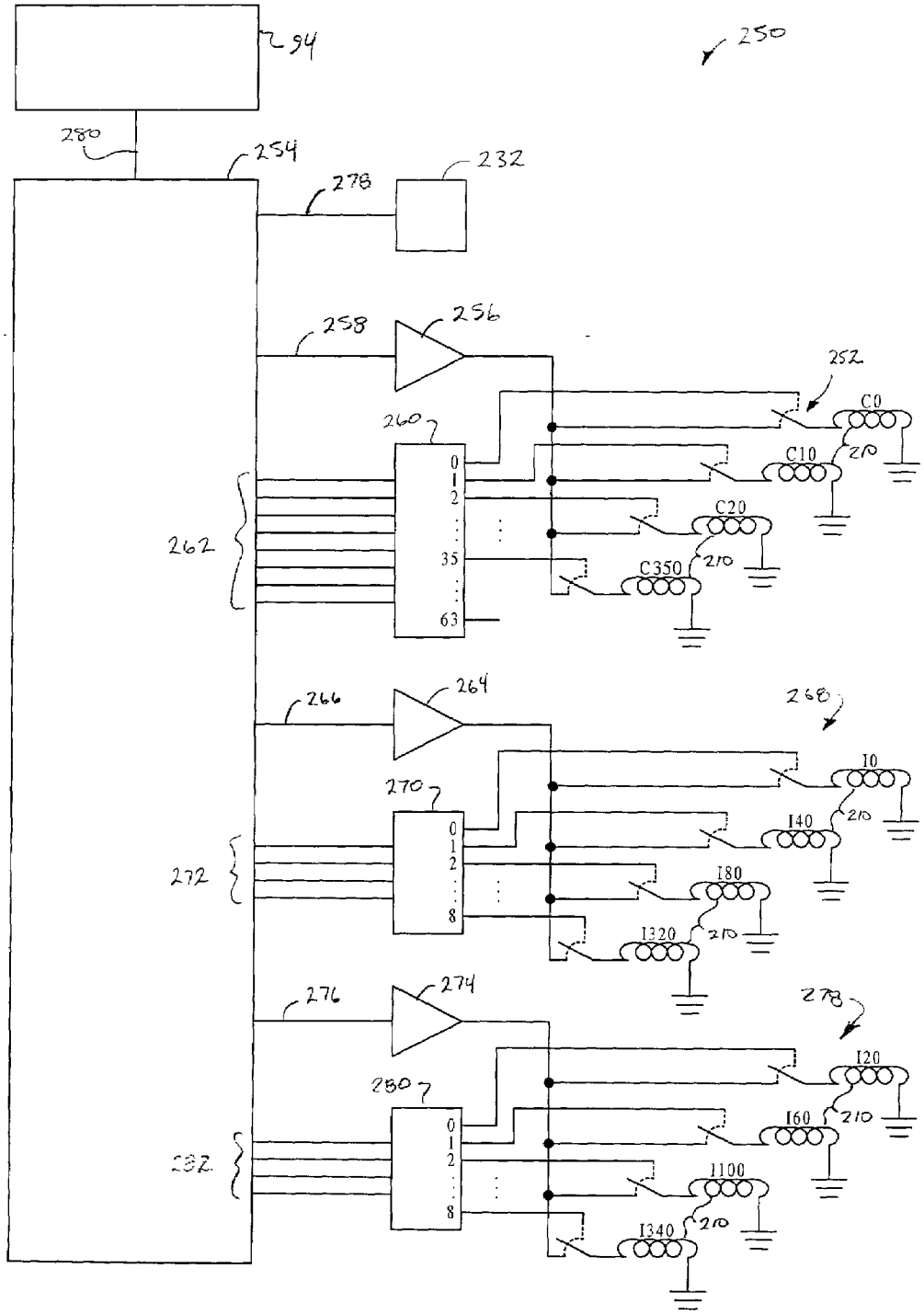
FIG. 15 is a schematic diagram of a control system for aiming a directional microphone according to an embodiment of the present invention.

Referring now to FIG. 15, a schematic diagram of a control system for aiming a directional microphone according to an embodiment of the present invention is shown. Control logic, shown generally by 250, controls which coils 210 will be turned on or off and, in some embodiments, the amount or direction of current supplied to coils 210. By appropriately energizing a sequence of coils 210, control logic 250 changes the position of microphone 208 relative to base 202.

Each coil 210 is connected through a switch, one of which is indicated by 252, to coil driver 234. The switch is controlled by the output of a decoder. Thus, one coil 210 in each set of coils may be activated at any time. Switch 252 may be implemented by one or more transistors as is known in the art. Decoders and drivers are controlled by processor 254 which may be implemented with a microprocessor, programmable logic, custom circuitry, and the like.

All of coils 210 in outer slot 214 are connected to coil driver 256 which is controlled by processor 254 through control output 258. One of the thirty six coils 210 from the set C0, C10, C20, . . . C350 is switched to coil driver 256 by 8-to-64 decoder 260 controlled by eight select outputs 262 from processor 254. The eighteen coils 210 in inner slot 216 are divided, alternatively, into two sets of nine coils each such that any neighboring coil of a given coil belongs in the opposite set from the set containing the given coil. Thus, coils I0, I40, I80, . . . . I320 are connected to coil driver 264 which is controlled by processor 254 through control output 266. One of the nine coils 210 from this inner coil set, indicated by 268, is switched to coil driver 264 by 4-to-16 decoder 270 controlled by four select outputs 272 from processor 254. Coils I20, I60, I100, . . . I340 are connected to coil driver 274 which is controlled by processor 254 through control output 276. One of the nine coils 210 from this inner coil set, indicated by 278, is switched to coil driver 274 by 4-to-16 decoder 280 controlled by four select outputs 282 from processor 254. If closed loop control of the position of housing 204 is desired, the position of housing 204 can be provided to processor 254 by position sensor 232 through position input 278.

Various arrangements for coil drivers 256, 264, 274 may be used. First, coil drivers 256, 264, 274 may operate to supply a single voltage to coils 210. Second, coil drivers 256, 264, 274 may provide either a positive or negative voltage to coils 210, based on digital control output 258, 266 and 276, respectively. This offers the ability to reverse the magnetic field produced by coil 210 switched into coil driver 256, 264, 274. Third, coil drivers 256, 264, 274 may output a range of voltages to coils 210 based on an analog voltage supplied by control output 258, 266 and 276, respectively. In the following discussion, the ability to switch between a positive or a negative voltage output from coil drivers 256, 264, 274 is assumed.

As an example of rotationally positioning microphones 208, consider moving housing 204 from a position at 0° to a position at 30°. Initially, coils C0 and I0 are energized to attract magnets 206. Motion begins when C0 is switched off, C10 is switched to attract, and I0 is switched to repel. Once housing 204 has rotated to approximately 10°, I20 is switched to attract, C10 is switched off, I10 is switched off, and C20 is switched to attract. Next, C30 is switched to attract, C20 is switched off, I20 is switched to repel and I40 is switched on. Finally, I20 and I40 are set to repel and C30 to attract to hold housing 204 at 30°.

Microphone 208 may be pointed at a sound source through a variety of means. For example, signal processor 94 may generate sound strength input 280 for processor 254 based on an average of sound strength from desired direction 86. If the level begins to drop, the rotational position of housing 204 is perturbed to determine if the sound strength is increasing in another direction. Alternatively, a microphone with a wider beam angle may be attached to housing 204. A plurality of microphones may also be attached to base 202 for triangulating the location of a desired sound source.

While embodiments of the invention have been illustrated and described, it is not intended that these embodiments illustrate and describe all possible forms of the invention. The words of the specification are words of description rather than limitation, and it is understood that various changes may be made without departing from the spirit and scope of the invention.

What is claimed is:

1. A system for acquiring sound in a particular direction from a sound source comprising:

at least one microphone, each microphone having a directional sensitivity comprising a minor lobe pointing in the particular direction of the sound source and a major lobe pointing in a direction other than the particular direction, the minor lobe having less sound sensitivity than the major lobe; and signal processing circuitry in communication with each microphone, the signal processing circuitry reducing the effects of sound received from directions of the microphone major lobe and enhancing the effect of the minor lobe.

2. A system for acquiring sound in a particular direction as in claim 1 wherein at least one microphone has a hypercardioid polar response pattern.

3. A system for acquiring sound in a particular direction as in claim 1 wherein at least one microphone is a gradient microphone.

4. A system for acquiring sound in a particular direction as in claim 3 wherein at least one gradient microphone has a non-cardioid polar response pattern.

5. A system for acquiring sound in a particular direction as in claim 1 wherein the signal processing circuitry comprises a digital signal processor.

6. A system for acquiring sound in a particular direction as in claim 1 wherein the signal processing circuitry reduces the effects of sound received from directions of the major lobe through spectral filtering.

7. A system for acquiring sound in a particular direction as in claim 1 wherein the signal processing circuitry reduces the effects of sound received from directions of the major lobe through gradient noise cancellation.

8. A system for acquiring sound in a particular direction as in claim 1 wherein the signal processing circuitry reduces the effects of sound received from directions of the major lobe through spatial noise cancellation.

9. A system for acquiring sound in a particular direction as in claim 1 wherein the signal processing circuitry reduces the effects of sound received from directions of the major lobe through signal separation.

10. A system for acquiring sound in a particular direction as in claim 1 wherein the signal processing circuitry reduces the effects of sound received from directions of the major lobe by threshold detection.

11. A system for acquiring sound in a particular direction as in claim 1 wherein the at least one microphone comprises a pair of microphones collinearly aligned in the particular direction.

12. A method for acquiring sound in a particular direction from a sound source comprising:

aiming a microphone in the particular direction, the microphone having a directional sensitivity comprising a first lobe pointed in the particular direction of the sound source and a second lobe pointed in a direction other than the particular direction, the first lobe having less sound sensitivity than the second lobe, the microphone generating an electrical signal based on sound sensed from the particular direction and from the direction other than the particular direction; and processing the electrical signal to reduce effects of sound sensed in the direction other than the particular direction and to enhance the effect of the first lobe.

13. A method for acquiring sound in a particular direction as in claim 12 wherein the first lobe is a minor lobe of a hypercardioid directional sensitivity and the second lobe is a major lobe of the hypercardioid directional sensitivity.

14. A method for acquiring sound in a particular direction as in claim 12 wherein the first lobe is one lobe of a gradient microphone directional sensitivity and the second lobe is another lobe of the gradient microphone directional sensitivity.

15. A method for acquiring sound in a particular direction as in claim 14 wherein the gradient microphone directional sensitivity exhibits non-cardioid directional sensitivity.

16. A method for acquiring sound in a particular direction as in claim 12 wherein processing the electrical signal comprises spectral filtering.

17. A method for acquiring sound in a particular direction as in claim 12 wherein processing the electrical signal comprises gradient noise cancelling.

18. A method for acquiring sound in a particular direction as in claim 12 wherein processing the electrical signal comprises spatial noise cancelling.

19. A method for acquiring sound in a particular direction as in claim 12 wherein processing the electrical signal comprises signal separation processing.

20. A method for acquiring sound in a particular direction as in claim 12 wherein processing the electrical signal comprises threshold detecting.

21. A system for acquiring sound in a particular direction from a sound source comprising:

at least one microphone, each microphone having a directional sensitivity comprising a first lobe pointing in the particular direction of the sound source and a second lobe pointing in a direction other than the particular direction, the first lobe having less sound sensitivity than the second lobe, the microphone converting sound from directions comprising the first lobe and the second lobe into an electrical signal; and means for reducing the effects of sound, received in directions of the second lobe, and to enhance the effect of the first lobe in the electrical signal.

22. A system for acquiring sound in a particular direction as in claim 21 wherein at least one microphone has a hypercardioid polar directional response pattern.

23. A system for acquiring sound in a particular direction as in claim 21 wherein at least one microphone is a gradient microphone.

24. A system for acquiring sound in a particular direction as in claim 23 wherein the gradient microphone has a non-cardioid polar response pattern.

25. A system for acquiring sound in a particular direction as in claim 21 wherein the at least one microphone comprises a pair of microphones collinearly located in the particular direction.

26. A method of improving the directionality of a hypercardioid microphone having a directional sensitivity comprising a minor lobe and a major lobe, the method comprising:

pointing the microphone minor lobe in a desired direction from a source of sound;

converting sound received in sensitive directions defined by the minor lobe and the major lobe into an electrical signal; and processing the electrical signal to reduce the effects of sound received in sensitive directions defined by the major lobe and thereby enhance the effect of the minor lobe.

* * * * *